US006498973B2

(12) United States Patent
Dix et al.

(10) Patent No.: US 6,498,973 B2
(45) Date of Patent: Dec. 24, 2002

(54) FLOW CONTROL FOR ELECTRO-HYDRAULIC SYSTEMS

(75) Inventors: Peter J. Dix, Naperville, IL (US); Alan D. Berger, Winfield, IL (US)

(73) Assignee: Case Corporation, Racine, WI (US)

( * ) Notice: Subject to any disclaimer, the term of this patent is extended or adjusted under 35 U.S.C. 154(b) by 97 days.

(21) Appl. No.: 09/750,867

(22) Filed: Dec. 28, 2000

(65) Prior Publication Data

US 2002/0087244 A1 Jul. 4, 2002

(51) Int. Cl.[7] ..... F04B 1/28

(52) U.S. Cl. ..... 701/50; 701/54; 417/216; 60/428

(58) Field of Search ..... 701/50, 54, 85; 60/427, 428, 452, 484, 426, 431, 433, 434; 74/733.1; 417/216; 180/321

(56) References Cited

U.S. PATENT DOCUMENTS 4,712,376 A 12/1987 Hadank et al. ..... 60/427
4,942,737 A * 7/1990 Tatsumi ..... 60/431
5,176,504 A * 1/1993 Moriya et al. ..... 417/216
5,201,177 A * 4/1993 Kim ..... 60/426
5,809,846 A * 9/1998 Ohkura et al. ..... 74/733.1

* cited by examiner

*Primary Examiner*—William A. Cuchlinski, Jr.
*Assistant Examiner*—Marthe Y. Marc-Coleman
(74) *Attorney, Agent, or Firm*—A. N. Teausch

(57) ABSTRACT

In a work vehicle that has several hydraulic actuators a system and method for controlling and scaling flow between the actuators includes an electronic controller that is connected to several hand controls that provide a proportional signal indicating how far the operator has moved the hand controls. The controller reads the hand controls and proportionally scales the total available flow to make sure the operator does not demand too much fluid from the hydraulic pump.

16 Claims, 3 Drawing Sheets

FLOW CONTROL FOR ELECTRO-HYDRAULIC SYSTEMS

CROSS-REFERENCE TO RELATED APPLICATION, IF ANY

Figure 1:
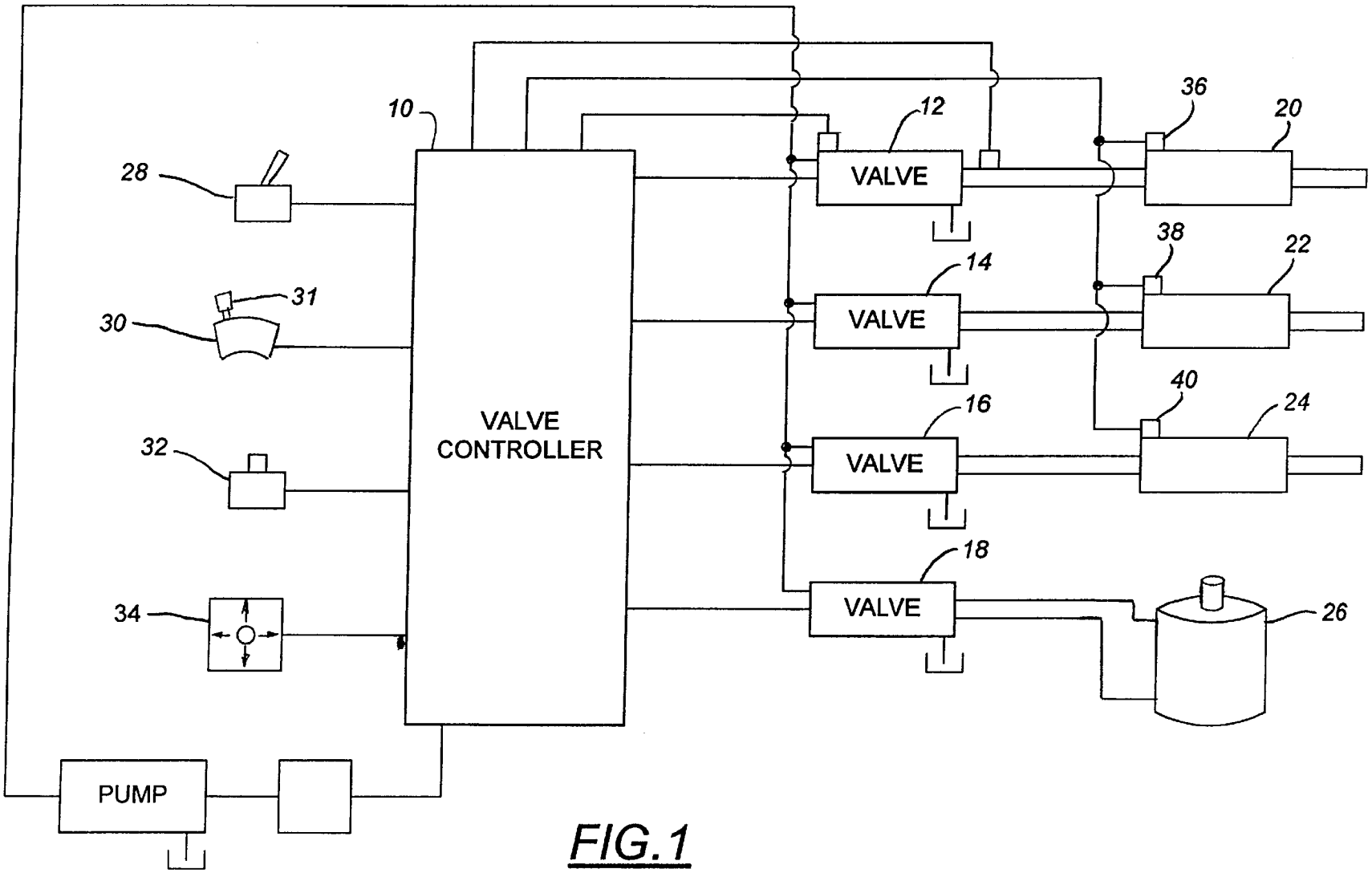

U.S. Pat. Ser. No. 09/196,675 filed on Nov. 20, 1998 for "Electronic Coordinated Control For A Two-Axis Work Implement" is referenced herein as a co-pending application.

FIELD OF THE INVENTION

This invention relates to a method for distributing hydraulic flow between a plurality of hydraulic actuators wherein at least one of the flow rates of the actuators is determined not by a manual control but by a valve controller.

BACKGROUND OF THE INVENTION

Many construction and work vehicles typically for earth moving purposes, have many, if not all of their systems, driven by hydraulic fluid. In the case of a backhoe, for example, the engine in the vehicle not only drives the backhoe over the ground, but drives boom swing cylinders that move the backhoe arm laterally side-to-side, as well as a boom cylinder to lift and lower the boom, a dipper cylinder to lift and lower the dipper and a bucket cylinder for opening and closing the bucket. In the case of a front loader, the engine not only drives the vehicle across the ground, but also drives a hydraulic pump that is connected to one or more arm cylinders to lift and lower the two arms on which the bucket is attached and one or more tilt cylinders to tilt the front loader bucket in or out with respect to the vehicle. In the case of road graders, for example, several different hydraulic actuators are used to angle the blade with respect to the road, tilt it, and raise it and lower it. In the case of forklifts, several hydraulic actuators are used to raise and lower the forks, tilt the forks backwards and forwards so the load will be located over the vehicle or away from the vehicle, and to extend the forks (in some types of lifts) to place a packet on a high shelf without moving the vehicle itself back and forth.

In addition to these examples, one should recognize that many work vehicles also provide for auxiliary hydraulic devices to be attached and detached for use in special situations. For example, hydraulic post hole diggers which include a hydraulic motor and a rotating bit approximately eight inches (8") in diameter are often attached to a front loader or a backhoe in place of the bucket. As another example, pneumatic or hydraulic pavement breakers are often mounted on the front of skid-steer loaders in place of a bucket to break up pavement. These attachments are typically separately controllable through an auxiliary hydraulic control manifold to which they are attached with quick-connects.

One of the continuing problems of work vehicles is that the market is highly competitive and they must be made to sell at a reasonable price. This always involves design and engineering trade-offs in which the designers and engineers attempt to identify the most common uses and ensure that the vehicle is able to perform those functions. The inevitable compromises typically include providing a hydraulic pump that does not have capacity sufficient to simultaneously drive every single hydraulic actuator and motor without being overloaded. By "overloaded" I mean that the motor cannot provide pressurized hydraulic fluid at a sufficient flow rate to drive all the devices simultaneously. Inevitably, in almost every work vehicle, there is some point within the performance envelope in which the pump, providing as much fluid as it can, is unable to drive the actuators and motors as fast as the operator commands them.

The operator commands these various actuators or motors by either operating on/off switches, by moving a proportional control lever, rotating a potentiometer, or manipulating a one or two axis joy stick. Most commonly, two or more of these controls are provided for the operator to manipulate. Most of the controls are configured to generate a flow rate roughly proportional to the degree of deflection of the control lever. By manipulating two proportional control levers, the operator can vary the speed of two separate hydraulic actuators in order to coordinate the movement of one or more actuators at the same time. For example, an operator may extend the boom of a backhoe while simultaneously lifting the dipper and opening the bucket by manipulating two joysticks, one in each hand. This permits the operator to substantially increase the productivity he would have if he could only operate one actuator at a time. In many earth working operations or excavating operations, the operator must control at least two actuators at once in order to dig or shape a hole in the ground, for example. If an operator of a backhoe is attempting to scrape the bottom of an excavation flat, he will typically have to operate the boom, the dipper, and the bucket cylinders simultaneously. No single control can be operated to follow the contours of the ground as accurately as all three together.

It is in these situations where the limitations of the pump are most apparent. An operator who is trying to simultaneously swing a boom while raising the boom, extending the dipper and opening the bucket may find that there is insufficient hydraulic fluid and one or more of the hydraulic cylinders may suddenly cease moving. If the operator has been manipulating in his various hand controls and levers in order to achieve a smooth coordinated movement, the sudden erratic motion of one hydraulic actuator may gouge the ground improperly, making an error in excavation that he must later go back and repair.

One result of this failure of the pump to provide sufficient pressurized hydraulic fluid flow is that operators instinctively slow down whenever they operate several different actuators simultaneously. From experience, they know that something may "grind to a halt" as they are trying to perform the coordinated operation. As a result, they slow the entire operation down until it is performed at a coordinated speed that they are reasonably assured will be within the flow capacity of the hydraulic pump on the vehicle. This, however, requires years of experience, and even with the experience, may cause the operator to operate well within the permissible total flow capacity of the pump, thus reducing his productivity. In other words, he may slow down unnecessarily.

In U.S. Pat. No. 4,712,376 issued to Hadank and assigned to Caterpillar Corporation at issue, one way of compensating for this problem was described. In the compensation method described in Hadank, the operator would simultaneously operate two controls moving them to positions that were roughly proportionate to the flow rate to the actuators and therefore to the speed of movement of the actuators. Rather than convert the control signals directly to a flow rate (or rather valve position) and drive the proportional control hydraulic valve to that opening, an electronic valve controller would read the signals from the two manual proportional controls (joysticks) would sum the two flow rates that were equivalent to those two positions and would determine what proportion of the total available flow from the pump those commanded flow rates (or valve openings) represented. For example, if the operator moved one control lever indicating that the hydraulic valve for that levers actuator should be open 100% and the operator moved another control lever for another actuator to a position that indicated it should also be open 100%, the control system would add these two requested flow rates or demand signals together. If the two 100% flow rates added up to 150% of the total hydraulic flow capacity of the hydraulic pump, the electronic valve controller would scale both of the signals back proportionately. In other words, since the operator was requesting for each flow controller 50% more flow than could be handled together, the electronic valve controller would send a proportionately reduced signal of 66% (instead of the 100%) to the first hydraulic valve and 66% (of the second hand control) to the second hydraulic valve. In this manner, the total flow permitted through the two proportional control valves would always be within the total flow capacity of the pump. No valve or actuator or motor would be starved of hydraulic fluid. What the operator would notice when manipulating the two hand controls was that the relative motion of each hydraulic actuator stayed the same, while the overall speed of both actuators was proportionately scaled back.

In recent years, however, electronically controlled work vehicles have become more and more commonplace. Part of this vehicle development has included the creation of several features and capabilities that were not heretofore possible. For example, many backhoes have an auxiliary hydraulic valve controller that responds to buttons and proportional control devices, such as thumb wheels on the operating levers, to permit the operator to set a predetermined auxiliary hydraulic flow rate. A typical case where this would occur would be where an operator of a backhoe wishes to spin the post hole digger at its most effective speed without having to constantly hold his hand on a proportional control lever to maintain that speed. The operator would like to vary the speed of the posthole digger at the end of the backhoe arm until it is at the optimum speed, then save that speed (e.g. valve opening/flow rate) and have the electronic controller maintain the posthole digger at that speed all the time as the operator manually moves the backhoe arm to which it is attached. As an additional complicating factor, work vehicles often coordinate the movement of several hydraulic actuators in response to the motion of a single operator device. Where the vehicle's controller coordinates the motion of several actuators by generating a time-varying signal or signals that it applies to one or more other actuators, the system shown in Hadank will not ensure that the total flow rate is within the capacity of the hydraulic pump.

SUMMARY OF THE INVENTION

In accordance with a first embodiment of the invention, a valve control system is disclosed for a work vehicle having a plurality of actuators coupled to a plurality of mechanical devices to move the devices, the vehicle having an internal combustion engine coupled to at least one hydraulic pump such that there is a total or maximum flow rate available from the at least one pump to be provided to the actuators to move the mechanical devices, such as a motor for an implement, a hydraulic cylinder that moves the bucket, dipper, or boom in a backhoe, a cylinder that raises or lowers a fork in a fork lift, or tilts a fork in a fork lift, or extends the forks at the top of a fork lift, or cylinders for raising the arms of a front loader or tilting the front loader bucket. The system includes a couple hand controls that produce signals equivalent to the distance they are moved by the operator, a controller to which they are attached, proportional control valves that are driven by the controller in response to the hind control signals and a signal developed or derived by the controller itself, and the actuators that are moved by the valves. The controller receives the hand control signals, processes them and generates the valve signals to open the valves accordingly. If the operator and the controller have requested too much flow—more flow that the pump on the vehicle can provide—the controller scales the flow to each actuator down, preferably proportionately, to insure that the flow demands as scaled are within the capacity of the pump to provide fluid. There may be some hydraulic devices, however, that need a set amount of flow and therefore should not be scaled. For these types of devices, the controller automatically provides them with their appropriate flow rate, subtracting this amount of flow off the top of the available flow, then proceeds to scale down and divide up the remaining flow among the remaining controllers.

DETAILED DESCRIPTION OF THE DRAWINGS

The present invention will become more fully understood from the following detailed description, taken in conjunction with the accompanying drawings, wherein like reference numerals refer to like parts, in which:

FIG. 1 illustrates a hydraulic valve control system including an electronic controller coupled to proportional control valves and the actuators they regulate. It also includes the various hand controls that the operator can use to signal the controller, directing it to open and close the various valves and thereby move the corresponding actuators.

Figure 2:
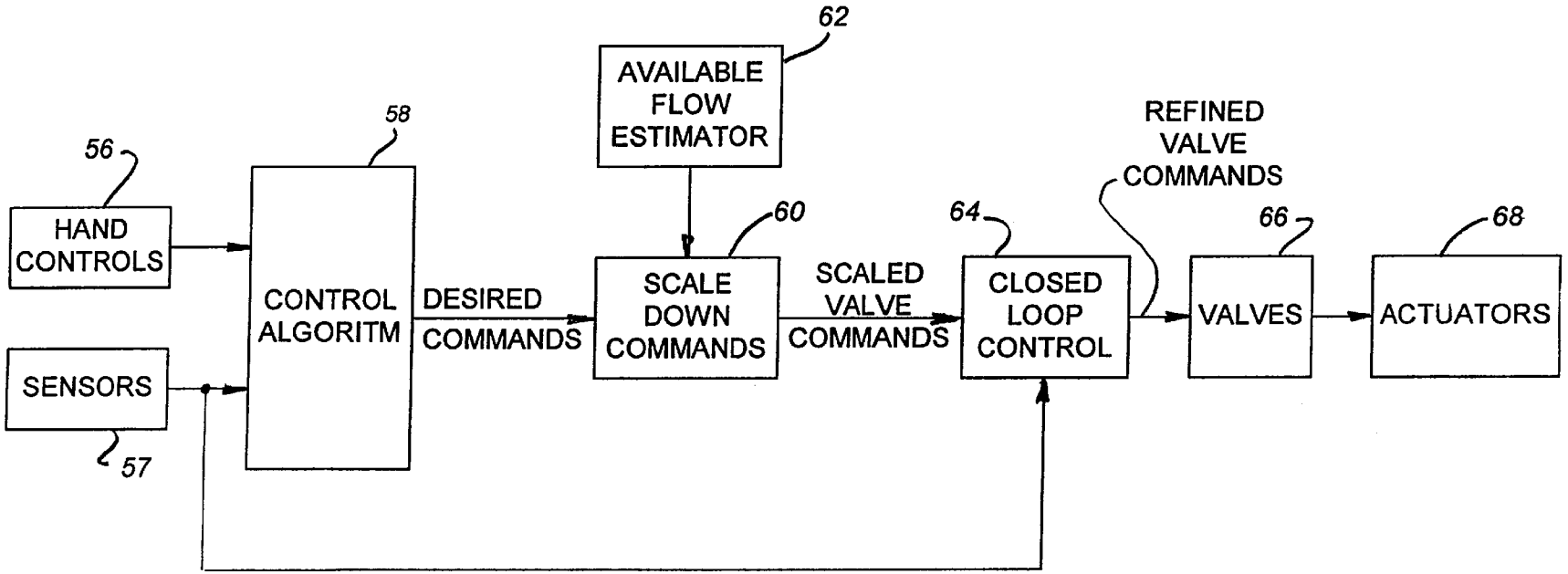

FIG. 2 shows the circuitry of the controller expressed in functional block form indicating how the controller receives and processes the signals from the hand controls. The controller receives hand control and sensor signal values on the left hand side of the FIGURE, derives command signal to the left of that, then scales the valve signals, then uses feedback control based upon the valve signals to refine the valve signals, then sends the refined valve signals to the actuators.

Figure 3:
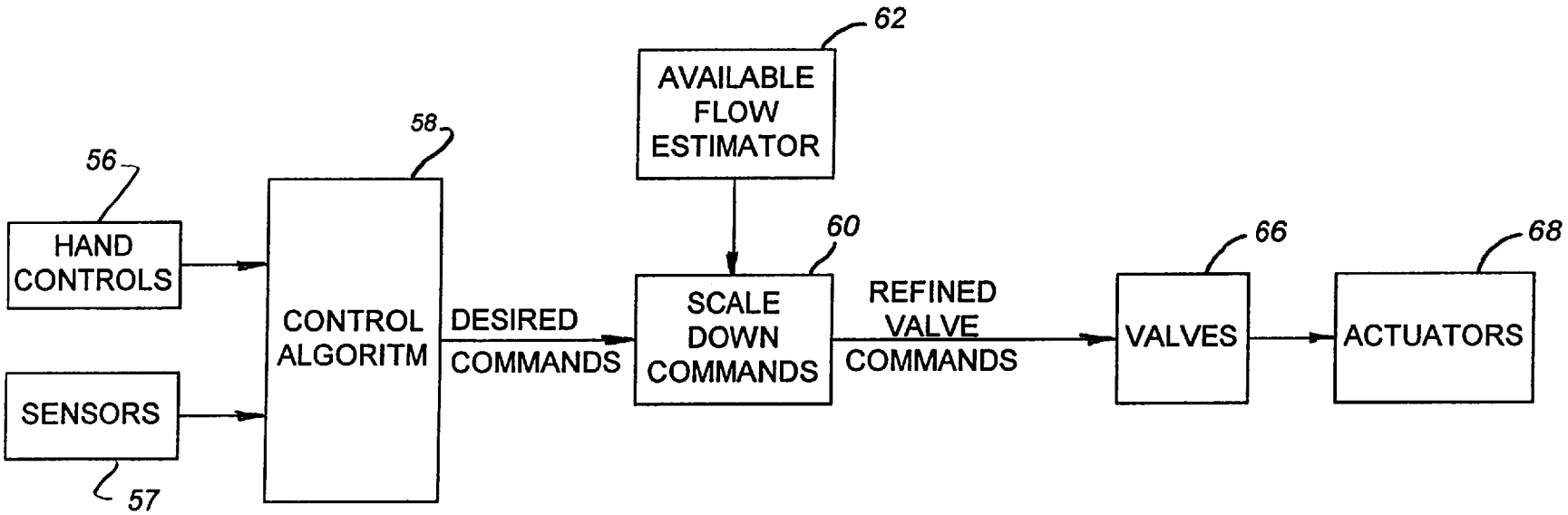

FIG. 3 shows the same subject matter of FIG. 2, but in an embodiment that does not use feedback control to refine the valve signals.

DETAILED DESCRIPTION OF THE INVENTION

Referring now to FIG. 1, valve controller 10 is shown that is coupled to and drives proportional control valves 12, 14, 16 and 18. While only four valves are shown, as indicated by FIG. 1, there is no limit on the number of proportional control valves that may be coupled to valve controller 10. Valves 12, 14 and 16 are connected to hydraulic cylinders 20, 22 and 24. Valves 12, 14, 16 control the flow of hydraulic fluid to cylinders 20, 22, 24 respectively, based upon signals received from valve controller 10. Valve 18 is similarly a proportional control valve and controls the flow of hydraulic fluid to a different hydraulic actuator, hydraulic motor 26. This motor may be coupled to a variety of rotational implements and is intended to represent any auxiliary hydraulic actuator on the vehicle. Inputs to valve controller 10 are shown on the left hand side of FIG. 1, including a on/off switch 28, a quadrant lever 30, a momentary push button switch 32, and a two-axis joystick 34. Switch 28 represents a two-position single throw switch generating a signal indicative of one or two positions. Quadrant lever 30 is representative of a proportional control device wherein the signal provided to valve controller 10 is proportional to the degree of deflection of the lever. Button switch 32 is indicative of a momentary contact switch with two states, on and off, wherein the button must be engaged manually in the on position, and when released, returns to the off position. Joystick 34 is indicative of a proportional control device having two independent axes of operation and capable of generating two proportional signals, each signal indicative of the degree of deflection of the joystick about each axis.

Associated with each of the three cylinders 20, 22 and 24 are position sensors 36, 38, 40. Each of these sensors is coupled to controller 10 and provides a signal to the controller indicative of the position of its associated cylinder. These sensors provide a signal that either directly, or as a function of mathematical manipulation, indicates the position of the cylinder, and hence the position of the mechanical elements that are coupled to the cylinders. As the operator moves hand controls 56, the sensors provide feedback to the controller to give it some indication of the actual amount of flow provided to the cylinders. In this manner, the controller can determine whether projected flow rates have been achieved, and closed loop feedback can fine tune the valve positions to make sure the maximum flow rate to the various actuators using hydraulic fluid is not exceeded. Alternatively, and as described below, the system may not require feedback from the sensors to allocate the proper amount of flow and keep that flow within the flow rate limit of the vehicle's pump.

The position sensors provide feedback indicative of the rate of flow of hydraulic fluid to the actuators. Typical cylindrical actuators and their pistons have a constant cross sectional area. For a specific change in piston position, there is a specific change in volume. If the piston changes from position A to position B in 2 seconds, the flow rate over that time interval is (B minus A) times piston area) divided by 2 (seconds).

There are other methods of determining the fluid flow rate to the actuators, including a spool position sensor 36' shown coupled to valve 12, or a fluid flow sensor 36" show coupled in the fluid supply line from valve 12 to actuator 20. For convenience of illustration, we have shown only one actuator (20) with these alternative means of determining flow rate/actuator position. All of the actuators could be similarly provided with these devices. In most proportional control valves, the position of the spool is proportional to the degree of opening of the valve, and hence indicative of the flow rate of the valve, assuming a constant pressure across the valve. In-line fluid flow sensors are made using a variety of technologies, including mass flow rate, velocity (using impellers or pitot tubes or the like.

The simplest measure of fluid flow rate to each actuator is the magnitude of the signal applied to the proportional control valve. The signal, however, may not be sufficiently precise for all applications, and other sensors that provide a signal indicative of flow such as the spool position sensor, the fluid flow sensor may be better employed. Optionally, "smart" proportional flow control valves may be used These valves include internal sensors and microprocessors that determine the actual flow rate internally and automatically correct the flow rate by moving the spool on their own. By incorporating internal feedback control of the flow rate through the valve, the user does not have to do it for himself by adding additional position or flow sensors to determine the actual flow rate. The flow rate sensors and the flow rate controller are inside the valve itself.

A pump controller 42 is coupled to both a hydraulic pump 44 and controller 10. In one embodiment, controller 10 transmits a signal to the pump controller indicative of a desired fluid flow rate and pump controller 42 responds by signaling pump 42 to provide that rate of hydraulic fluid flow. The pump controller is preferably a swash plate controller configured to dynamically change the output of the pump, and hence the total hydraulic flow rate available for the hydraulic actuators. The existence and operation of such controllers are well known in the art.

Pump 44 is driven by engine 46. Engine 46 is preferably an internal combustion engine that operates at a relatively constant speed while controller 10 moves the mechanical elements that are coupled to the hydraulic actuators. In a typical embodiment, the vehicle is a backhoe, a front loader, a skid-steer loader a fork-lift or similar device, in which the hydraulic actuators swing, raise and lower buckets, booms, or forks. It is these machine elements that the operator controls and coordinates using the hand controls, and it is these elements that, if all driven simultaneously by the operator at full speed, would outstrip the flow rate provided by the pump, even if the pump was operated at its highest flow capacity.

Referring now to FIG. 2, the basic operation/circuitry of controller 10 is shown. In the preferred embodiment, shown in FIG. 1, controller 10 is a digital device, and includes a microprocessor (or microcontroller) and memory circuits configured to store a control program. The circuitry described below is encoded in the control program that the microprocessor executes. While the controller may be an analogue device and the circuitry hardwired using analog devices, this is not preferred, since the ability to change an analogue device's operation or reconfigure it to provide additional functions is quite limited.

Referring to the right-most portion of FIG. 2, the inputs to the controller are signals generated by hand controls 56. In addition, the positions of the actuators provided by sensors 36, 38, 40 are also input into the algorithm.

These values are provided to a control algorithm 58 that calculates desired command signals based upon the operator's manipulation of the hand controls. In addition to generating valve signals from the operator hand controls, the controller may also generate valve signals based upon the hand control signals for an additional actuator or actuators.

Once the desired command signals are calculated, they are then scaled down in block 60 to stay within a static (or dynamic) estimate (block 62) of available hydraulic fluid flow from the pump.

Once the scaled-down commands are calculated, they are further modified in block 64 using feedback from the actuator position or flow rate sensors to ensure that the motion of the actuators is properly coordinated.

These valve commands are then applied to valves 12, 14, 16, and 18 (in block 66). The valves, in turn, control the flow rate of hydraulic fluid applied to hydraulic actuators 20, 22, 24, and 26 (in block 68).

Referring now to FIG. 3, an alternative embodiment of the controller's circuitry is illustrated wherein there is no feedback control after the command signals are scaled. In this embodiment, there is no feedback control block 64. Once scaled, the command signals are applied to the valves. In applications where positional accuracy of the various actuators is not critical, it is acceptable to omit the feedback processing indicated by block 64. In all other respects, the operation of the algorithms in FIG. 2 and FIG. 3 are identical.

Referring back to FIG. 2, the controller reads the sensor signals and hand control signals in block 58. Switch 28 (FIG.

1) indicates whether valve 18 will be energized to supply hydraulic fluid to motor 26. If it is turned on, the controller calculates a desired command signal that will provide a constant flow of fluid to motor 26. The amount of fluid to be provided is proportional to the position of quadrant lever 31.

In addition, in block 58 controller 10 receives the signals provided by joystick 34, another hand control. Joystick 34 provides two separate signals, each signal equivalent to the degree of deflection of the joystick in one of the two orthogonal directions. Thus, by manipulating the joystick, the operator can provide two separate and distinct signals indicative of a degree of deflection of the joystick.

In the preferred embodiment, one of these joystick signals is equivalent to the desired speed of movement of actuator 20, and hence the flow rate to actuator 20. The faster the operator wishes actuator 20 to move, the farther the operator deflects the joystick about one axis.

The other joystick signal is indicative of the desired speed of movement of actuator 22 and hence the flow rate to actuator 22. The faster the operator wishes actuator 22 to move, the farther the operator deflects the joystick about the other of the two orthogonal directions.

Controller 10 calculates a desired valve command for each of these actuators 20, 22 that is indicative of the requested or desired flow rate. Note that the operator need not manipulate the joystick in both orthogonal directions simultaneously, and therefore the controller may receive only a single signal from the joystick indicative of an operator request to move a single actuator.

In addition to converting the joystick signals, quadrant lever signal, and switch signal into a plurality of requested flow rates, controller 10 derives a third request signal for actuator 24. This signal is not provided by the operator, but is a time-varying signal developed by the controller that is typically based upon the joystick signal (or signals) and varies with them.

In the example described herein, the operator requests the motion of two actuators using a joystick. The controller itself derives the desired motion of the third actuator in order to coordinate the motion of the three actuators, 20, 22, 24. This is typically done as a part of a trajectory planning program, such as that described in co-pending application Ser. No. 09/196,675 for an "Electronic Coordinated Control For A Two-Axis Work Implement" which is incorporated herein by reference for all that it teaches. In the specific embodiment shown in the 09/196,675 application, the controller determines, based upon signals produced by the operator controls, the anticipated motion of one actuator, and based upon the mechanical geometry and location of the front loader arms, calculates a valve signal for another actuator that will insure a loader bucket remains level when it is raised and lowered. The operator, using a single control, indicates that the loader arms should be raised or lowered, and, by the degree of deflection of that control, indicates the desired speed of raising or lowering. In other words, the operator generates a request indicative of the desired degree of valve opening of the loader arm cylinder valve.

While this is one example of the reasons the controller might generate a time varying desired valve signal on its own, it by no means exhausts the possibilities. The present control system may be used to regulate the operation of a backhoe, wherein the operator requests the motion of one or two actuators that manipulate the backhoe arm using the joystick and the controller supplies the valve signal for a second or third actuator in order to coordinate the motion of two or three of the actuators that control the backhoe arm. A typical case where this would be valuable is when the operator is using a backhoe to dig a hole for a foundation that must have a flat bottom. Trajectory planning to coordinate the motion of a plurality of actuators is well known in the art.

The present system is not intended to be limited to a vehicle having any particular algorithm by which the controller calculates a desired valve signal, but to cover a controller operating in accordance with any such algorithms.

At this point, the controller has converted the signals from the hand controls into a request signal indicative of the desired speed of rotation of the hydraulic motor 26 and at least one request signal indicative of the desired speed of motion of at least one of the hydraulic cylinders. In this case, actuators 20 and 22.

The controller has also derived a valve signal that was not provided by the operator for at least one other actuator. In this case, actuator 24.

Once the desired valve signals or commands have been requested, controller 10 appropriately scales them to stay within the total flow capacity of the pump (block 60). This calculation is based upon an estimate of the total available flow capacity of the hydraulic pump that is stored in the memory circuits of controller 10 (block 62).

There are two types of actuators for purposes of this scaling operation: priority flow rate actuators and scaled flow rate actuators. We will explain the significance of these two types of actuators by providing a typical example of a particular application.

In this example, the system is implemented in a backhoe. The three hydraulic cylinders 20, 22 and 24 include a boom lift cylinder, a dipper cylinder and a bucket cylinder. Hydraulic motor 26 is attached to the end of the boom for driving a post-hole drill bit, for example. A bit is attached to the rotating shaft of the motor and the boom lowered so the bit can engage the ground and dig a post-hole. The assembly of the post-hole bit and the actuator (motor 26) that drives it are one example of a ground-engaging implement that may need a constant flow rate of fluid. Other common examples include pavement breakers and lawn mower heads. The present application is not intended to be limited to a system for any specific hydraulic actuator that needs a constant flow rate of hydraulic fluid, but is intended to encompass any of them.

It is preferable that the post-hole digger rotate at a constant and optimum speed. To do this, a constant supply of hydraulic fluid needs to be supplied to the post hole digger no matter how the operator manipulates the joystick associated with two of the three cylinders. To accommodate this need for a constant supply of fluid to motor 26, controller 10 first allocates a predetermined amount of flow rate from the total available flow rate by subtracting this amount from the total available flow rate.

In the present example, since the position of the quadrant lever indicates the desired flow rate for motor 26, amount of fluid flow corresponding to the position of the quadrant lever is subtracted from the total available flow. This constant flow rate will be applied to motor 26. Motor 26 is therefore a priority flow rate type of actuator. Note that while only a single priority flow rate actuator is shown in the present application, the invention is not intended to be limited to a vehicle having only one such actuator. Indeed, there may be more than one priority flow rate actuators on more complex vehicles together with associated hand controls to indicate the desired flow rate that should be applied to those actuators. Note also that the operator can change the flow rate by moving the quadrant lever to another position and releasing it. Indeed, the operator can eliminate any priority flow rate device by simply turning it off, such as by flipping switch 28. The term "priority" as used herein means a flow rate that, while typically constant, is not scaled, but is given its full commanded flow rate. The scaled flow rate actuators, in contrast to this, are provided with the remaining flow rate which may, if the total remaining available flow is insufficient, be scaled proportionately.

Once controller 10 has subtracted the priority flow rate for the priority flow rate actuator (or actuators, more generally), it then proceeds to scale the remaining request signals (for the scaled flow rate actuators) proportionally. The remaining request signals include the operator request signals for actuators 20 and 22 and also the computer-generated request signal for actuator 24. These signals are preferably equivalent to the desired flow rate to each of their corresponding actuators, and thus to the speed at which the actuators move, and thus also to the degree of valve opening (assuming a constant supply of hydraulic fluid under pressure, of course).

Controller 10 combines desired variable flow rates together and subtracts them from the total available flow rate from the pump (reduced by the amount of flow that is sent to the priority flow rate actuator or actuators). In most applications, and especially in applications where the controller generated the third valve signal as part of a trajectory analysis, the flow rates are scaled proportionately to the total available flow remaining after any flow rates for priority flow devices have been subtracted. The result of this scaling will be that all the scaled actuators receive less than their individually requested flows. They will each be reduced proportionately, however, thus keeping the various mechanical elements controlled by the scaled actuators in their proper relative positions.

Using the example of the backhoe, discussed above, the positional trajectory of the bucket or of an implement that is installed in place of the bucket will be the same if all the flow rates to the boom cylinder, the dipper cylinder, the boom swing cylinder, and the bucket cylinder are scaled down proportionately. The arm of the backhoe will just move at a slower speed. The paths or trajectories traced by the various mechanical elements that comprise the backhoe arm will be identical at either the requested speeds/flow rates or the scaled speeds/flow rate.

At this point, the controller has received at least one operator command, (preferably at least two), from the joystick and it (they) has been converted into desired valve commands for at least one (preferably at least two) operator-commanded actuator. The computer has developed its own desired valve command for a computer commanded actuator. The computer has also received an operator command for a priority flow rate actuator.

It has subtracted a priority flow rate (received from the quadrant lever) from the total available flow rate, then divided the remaining available flow rate between the at least one operator commanded actuator and the computer commanded actuator. Thus, the combined flow rates of the priority and scaled devices are less than or equal to the total available flow rate, the priority actuator will receive its priority flow rate, and the remaining actuators will share proportionately the remaining available flow rate.

The signals indicative of these flow rates (both priority and scaled) may be applied directly to the valves that control these devices, such as shown in FIG. 3, or they may be tailored to achieve higher accuracy as shown in FIG. 2.

In FIG. 2, the scaled valve signals or valve commands are then fine tuned in a closed loop position control circuit shown as block 64 in FIG. 2. In this step of the process, controller 10 compares the actual position of actuators 20, 22, and 24 with their projected positions to see whether they have actually reached their desired positions. If not, one or more flow rates are adjusted using a PID control algorithm to ensure that they do reach their positions. In the backhoe example provided above, one of the reasons for having the controller derive a control signal to apply to a computer-commanded actuator (cylinder 24 in this example) was to ensure that the backhoe boom followed a particular trajectory. If the trajectory (i.e. the sequence of positions) of the backhoe is particularly important, it may not be sufficient to merely provide scaled valve commands to the valves. Frictional losses, sticky valves, valve hysteresis, backhoe arm joint wear, and other problems common to mechanical and hydraulic devices may cause the mechanical components of the arm to follow a different path than the one they might have followed when the backhoe was new. While this is not a critical problem in many applications, it may be in some applications, and for that reason, the addition of a feedback control system using actuator position (or a signal indicative of actual flow rate form which the position can be derived) is particularly valuable.

In block 64, the controller receives the scaled valve commands for each of the actuators. The valve commands are related to actuator position in the following manner. Each valve inherently has a valve curve that relates the valve opening to the electrical signal applied to the valve. Typically, the greater the current through the valve coil, the larger the valve opening. These curves are generally linear, although they may vary depending upon the application. The volume of a typical cylindrical actuator is a function of the piston area and the piston position within the cylinder. The flow rate (unit of volume per unit of time) into or out of a cylinder is therefore directly related to the rate of change of the piston position. The flow rate through a valve is a function of the pressure across the valve and the size of the valve opening. As a result of these relationships (and the relationships vary in their details from valve to valve and actuator to actuator) a piston velocity versus valve opening curve can be developed. For a given valve signal, therefore, the controller can estimate how far the piston should move over any particular interval.

For this reason, in block 66 of FIG. 2, controller 10 compares the distance the actuator moves during each interval (using the signal from sensor 36) to see if the calculated flow rate signal applied to valve 18 actually produced the desired flow rate over that interval. Alternatively, the controller compares the flow rate as indicated by sensors 36' and 36" with the desired flow rate. If the flow rate is insufficient controller 10 modifies the valve command signal for the actuator by increasing it slightly. Similarly, if the actuator has moved too far per sensor 36, or has too high a flow rate per sensors 36' or 36", the closed loop control of block 64 reduces the valve signal slightly to reduce the speed of the actuator.

In the backhoe example above, the actuator that is controlled is the bucket cylinder 24. The closed loop control insures that the desired flow rate determined by the trajectory analysis performed by controller 10 is actually achieved and therefore that the bucket arrives at the proper bucket position at the proper time. Each of the other actuators, as well can be fine tuned using the control Details of a typical closed loop controller for one or more actuators may be found in the Ser. No. 09/196,675 application, in particular in FIGS. 7A and 7B.

From the above it can be seen that a system for controlling the flow rates to a plurality of hydraulic actuators on a vehicle in order to prevent exceeding the maximum flow capacity of a hydraulic supply is possible. The flow rates can include priority flow rates that are insured a specific amount of flow combined with other flow rates that are scaled to remain under a total flow rate capacity. The scaled flow rates can include flow rates for actuators for which the operator selects a desired rate using a proportional control input device, as well as for actuators that have a computer-generated flow rate.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims.

What is claimed is:

1. A valve control system for a work vehicle having a plurality of actuators coupled to a plurality of mechanical devices to move the devices, the vehicle having an internal combustion engine coupled to at least one hydraulic pump such that there is a total or maximum flow rate available from the at least one pump to be provided to the actuators to move the mechanical devices, the system comprising:

a. a first operator input device that provides a first signal indicative of a degree of deflection of the first device;

b. a second operator input device that provides a second signal indicative of a degree of deflection of the second device;

c. a first proportional flow control valve responsive to a first valve signal and configured to provide a first hydraulic flow at a flow rate proportional to the first valve signal, the first valve being fluidly coupled to a source of hydraulic fluid flow providing the maximum available flow rate;

d. a first hydraulic actuator coupled to the first valve and responsive to the first hydraulic flow;

e. a second proportional flow control valve responsive to a second valve signal and configured to provide a second hydraulic flow at a flow rate proportional to the second valve signal, the second valve being fluidly coupled to the source of hydraulic fluid flow to providing the maximum available flow rate;

f. a second hydraulic actuator coupled to the second valve and responsive to the second hydraulic flow;

g. a third proportional flow control valve responsive to a third valve signal and configured to provide a third hydraulic flow at a flow rate proportional to the third valve signal;

h. a third hydraulic actuator coupled to the third valve and responsive to the third hydraulic flow;

i. at least one valve controller circuit coupled to the first and second operator input devices and configured to:

i. retrieve a value indicative of a maximum available hydraulic fluid flow rate, ii. subtract a value indicative of the third valve flow rate from the maximum flow rate value to leave a value indicative of a remaining available flow rate, iii. proportionately scale values indicative of the first and second flow rates such that their sum is less than the remaining available flow rate, and iv. convert the first, second and third values into valve control signals and apply them to the first, second and third hydraulic actuators.

2. The system of claim 1, wherein the third hydraulic actuator is a rotating hydraulic motor.

3. The system of claim 1, wherein the first and second hydraulic actuators move members extending from the vehicle.

4. The system of claim 1, further comprising a first sensor coupled to the controller and configured to generate a first sensor signal indicative of an actual flow rate to the first actuator.

5. The system of claim 1, wherein the first sensor is one of the group consisting of a cylinder position sensor, a valve spool sensor, and a flow sensor disposed to sense the fluid flowing to the first actuator.

6. The system of claim 1, wherein the controller is configured to modify the first valve signal based upon the first sensor signal to provide a more accurate flow rate to the first actuator.

7. The system of claim 1, further comprising a second sensor coupled to the controller and configured to generate a second sensor signal indicative of an actual flow rate to the second actuator, wherein the controller is configured to modify the first valve signal based upon the second sensor signal to provide a more accurate flow rate to the second actuator.

8. The system of claim 1, further comprising a third sensor coupled to the controller and configured to generate a third sensor signal indicative of an actual flow rate to the third actuator, wherein the controller is configured to modify the third valve signal based upon the third sensor signal to provide a more accurate flow rate to the third actuator.

9. A valve control system for a work vehicle having a plurality of actuators coupled to a plurality of mechanical devices to move the devices, the vehicle having an internal combustion engine coupled to at least one hydraulic pump such that there is a total or maximum flow rate available from the at least one pump to be provided to the actuators to move the mechanical devices, the system comprising:

a. a first operator input device that provides a first signal indicative of a degree of deflection of the first device;

b. a second operator input device that provides a second signal indicative of a degree of deflection of the second device;

c. a first proportional flow control valve responsive to a first valve signal and configured to provide a first hydraulic flow at a first flow rate proportional to the first valve signal, the first valve being fluidly coupled to a source of hydraulic fluid flow providing the maximum available flow rate;

d. a first hydraulic actuator coupled to the first valve and responsive to the first hydraulic flow;

e. a second proportional flow control valve responsive to a second valve signal and configured to provide a second hydraulic flow at a second flow rate proportional to the second valve signal, the second valve being fluidly coupled to the source of hydraulic fluid flow to providing the maximum available flow rate;

f. a second hydraulic actuator coupled to the second valve and responsive to the second hydraulic flow;

g. a third proportional flow control valve responsive to a third valve signal and configured to provide a third hydraulic flow at a third flow rate proportional to the third valve signal;

h. a third hydraulic actuator coupled to the third valve and responsive to the third hydraulic flow;

i. at least one valve controller circuit coupled to the first and second operator input devices and configured to:

i. retrieve a value indicative of a maximum available hydraulic fluid flow rate, ii. internally derive a value indicative of the third flow rate, iii. proportionately scale values indicative of the first, second and third flow rates such that their sum is less than the maximum available flow rate, and iv. convert the first, second and third values into valve control signals and apply them to the first, second and third hydraulic actuators.

10. The system of claim 9, further comprising:

a. a fourth proportional flow control valve responsive to a fourth valve signal and configured to provide a fourth hydraulic flow at a flow rate proportional to the fourth valve signal;

b. a fourth hydraulic actuator coupled to the fourth valve and responsive to the fourth hydraulic flow, wherein the controller is configured to apply the fourth valve signal to the fourth valve and to reduce the maximum available flow rate proportionately prior to proportionately scaling the values.

11. The system of claim 10, further comprising:

a third operator input device configured to generate a third signal proportionate to the degree of deflection of the third operator input device, the third signal being proportionate to the fourth valve signal, wherein the controller is configured to convert the third signal into the fourth valve signal.

12. A method of preventing a plurality of hydraulic valves and actuators from demanding too much flow from a hydraulic supply comprising the steps of:

a. providing to an electronic valve controller a first hydraulic flow request signal indicative of a degree of deflection of a first operator input device;

b. providing to the electronic valve controller a second hydraulic flow request signal indicative of a degree of deflection of a second operator input device;

c. generating in an electronic valve controller a third hydraulic flow request signal indicative of a third hydraulic flow;

d. retrieving in the electronic controller a value indicative of a total available flow rate provided by a hydraulic fluid source;

e. providing a reduced available flow rate by removing a value indicative of the third flow request signal from the value indicative of the total available flow rate;

f. proportionately scaling values indicative of the first and second hydraulic flow request signals such that their sum is less than the reduced available flow rate;

g. converting the first, second and third indicative values into first, second, and third valve control signals and apply them to first, second and third hydraulic proportional control valves;

h. directing the flow from the first, second and third valves to first, second and third hydraulic actuators, respectively; and i. continually and automatically repeating steps a–g.

13. The method of claim 12, wherein the first and second hydraulic actuators are hydraulic cylinder configured to move mechanical members extending from the vehicle.

14. The method of claim 12, further comprising the steps of:

generating a first sensor signal indicative of a first actual flow rate to the first actuator; and modifying the first valve control signal in the electronic controller based upon the first sensor signal to provide a more accurate flow rate to the second actuator.

15. The method of claim 14, wherein the first sensor is one of the group consisting of a cylinder position sensor, a valve spool sensor, and a flow sensor disposed to sense the fluid flowing to the first actuator.

16. The method of claim 15, further comprising the steps of:

generating a second sensor signal indicative of an actual flow rate to the second actuator; and modifying the second valve control signal based upon the second sensor signal to provide a more accurate flow rate to the second actuator.

* * * * *